US006236298B1

(12) United States Patent
Chen

(10) Patent No.: US 6,236,298 B1
(45) Date of Patent: May 22, 2001

(54) COIL RACK FOR A TRANSFORMER

(75) Inventor: James Chien-Chung Chen, Taipei (TW)

(73) Assignee: Atech Technology Co., Ltd., Taipei (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/167,710

(22) Filed: Oct. 7, 1998

(51) Int. Cl.[7] ..... H01F 27/30; H01F 27/29
(52) U.S. Cl. ..... 336/208; 336/192; 336/198
(58) Field of Search ..... 336/192, 198, 336/208

(56) References Cited

U.S. PATENT DOCUMENTS 3,189,772 * 6/1965 Wingler et al. ..... 336/198
3,189,857 * 6/1965 Jones ..... 336/198
3,359,395 * 12/1967 Bruce ..... 336/192
4,238,753 * 12/1980 Bayer ..... 336/192
4,857,877 * 8/1989 Dethienne ..... 336/198
5,281,942 * 1/1994 Stokes ..... 336/198
5,534,839 * 7/1996 Mackin et al. ..... 336/192
5,726,616 * 3/1998 Bell ..... 336/192
5,815,061 * 9/1998 Ho ..... 336/192

* cited by examiner

*Primary Examiner*—Anh Mai
(74) *Attorney, Agent, or Firm*—Dougherty & Troxell

(57) ABSTRACT

A coil rack for transformer including a coil winding seat around which an inner and an outer coil windings are sequentially provided. Axially extended through holes are formed on a bottom of the coil winding seat at positions spaced below the inner coil winding. Stoppers are provided to separately locate radially outside the through holes. Each of the stoppers is provided at a bottom surface with a radially extended open channel of which one end leads to the through hole and another end to an outer end of the coil rack. Free ends of the inner coil winding are separately guided downward via the axially extended through holes and then outward via the radially extended open channels on bottom surface of the stoppers to avoid contact with the outer coil winding and any possible short circuit.

1 Claim, 4 Drawing Sheets

COIL RACK FOR A TRANSFORMER

BACKGROUND OF THE INVENTION

The present invention relates to an improved coil rack for a transformer, and more particularly to a transformer coil rack that is provided with means for guiding free ends of an inner coil winding of the transformer, so that the free ends of the inner coil winding can be axially pulled downward and then radially pulled outward to reach and be welded to terminals at outer ends of the coil rack. The guiding means prevent the free ends of the inner coil winding from contacting with an outer coil winding wounded around the inner coil winding and therefore prevent any possible short circuit caused by such contact.

A transformer mainly includes a coil rack around which an inner coil winding, a first insulating layer, an outer coil winding, and a second insulating layer are sequentially provided. Free ends of the inner and the outer coil windings are extended outward to be welded to terminals provided on the coil rack. The insulating layers prevent short circuit caused by undesirable contact of the inner coil winding with the outer coil winding.

FIG. 1 illustrates a conventional coil rack 10 that provides a coil winding seat 11. Radially extended channels 12 are provided on a lower surface of the coil winding seat 11 to end at two outer ends of the coil rack 10. There are also terminals 13 connected to the outer ends of the coil rack 10 for connecting free ends of inner and outer coil windings 14, 15 thereto. The terminals 13 are also used to connect the coil rack 10 to an electronic substrate (not shown).

As shown in FIG. 2, the inner coil winding 14 is provided around the coil winding seat 11 first. A first insulating layer 16 is then provided around the inner coil winding 14. Free ends of the inner coil winding 14 are pulled outward to pass through two of the channels 12 and finally welded to the terminals 13 adjacent to the channels 12. Then, the outer coil winding 15 is provided around the first insulating layer 16 and free ends of the outer coil winding 15 are welded to the other terminals 13. Finally, a second insulating layer 16 is provided around the outer coil winding 15 to form a transformer as shown in FIG. 3.

After the inner and the outer coil windings 14, 15 are sequentially provided around the coil winding seat 11, their free ends must be pulled outward along the channels 12 for them to be welded to the terminals 13. Since the channels 12 are radially extended through the lower surface of the coil winding seat 11, the free ends of the inner coil winding 14 being radially pulled outward along the channels 12 tend to contact with the outer coil winding 15 easily, as illustrated in FIG. 2, that will cause not only dangerous short circuit but also high bad yield in the production of transformers.

SUMMARY OF THE INVENTION

It is therefore a primary object of the present invention to provide an improved coil rack for a transformer. The improved coil rack is provided on a bottom of a coil winding seat thereof with axially extended through holes. These through holes are spacedly located below an inner coil winding provided around the coil winding seat. Stoppers are formed below the coil rack to separately locate radially outside the through holes. Each of the stoppers is provided at a bottom surface with a radially extended open channel of which one end leads to the through hole and another end to an adjacent outer end of the coil rack. Whereby, free ends of the inner coil winding around the coil winding seat can be guided downward via the through holes and then outward via the open channels to reach and be welded to terminals at outer ends of the coil rack without contacting with an outer coil winding outside the inner coil winding. Short circuit caused by contact of the inner coil winding with the outer coil winding can therefore be avoided.

BRIEF DESCRIPTION OF THE DRAWINGS

The above and other objects as well as a detailed structure of the present invention can be best understood by referring to the following detailed description of the preferred embodiments and the accompanying drawings, wherein.

DETAILED DESCRIPTION OF THE PREFERRED EMBODIMENTS

Figure 1:
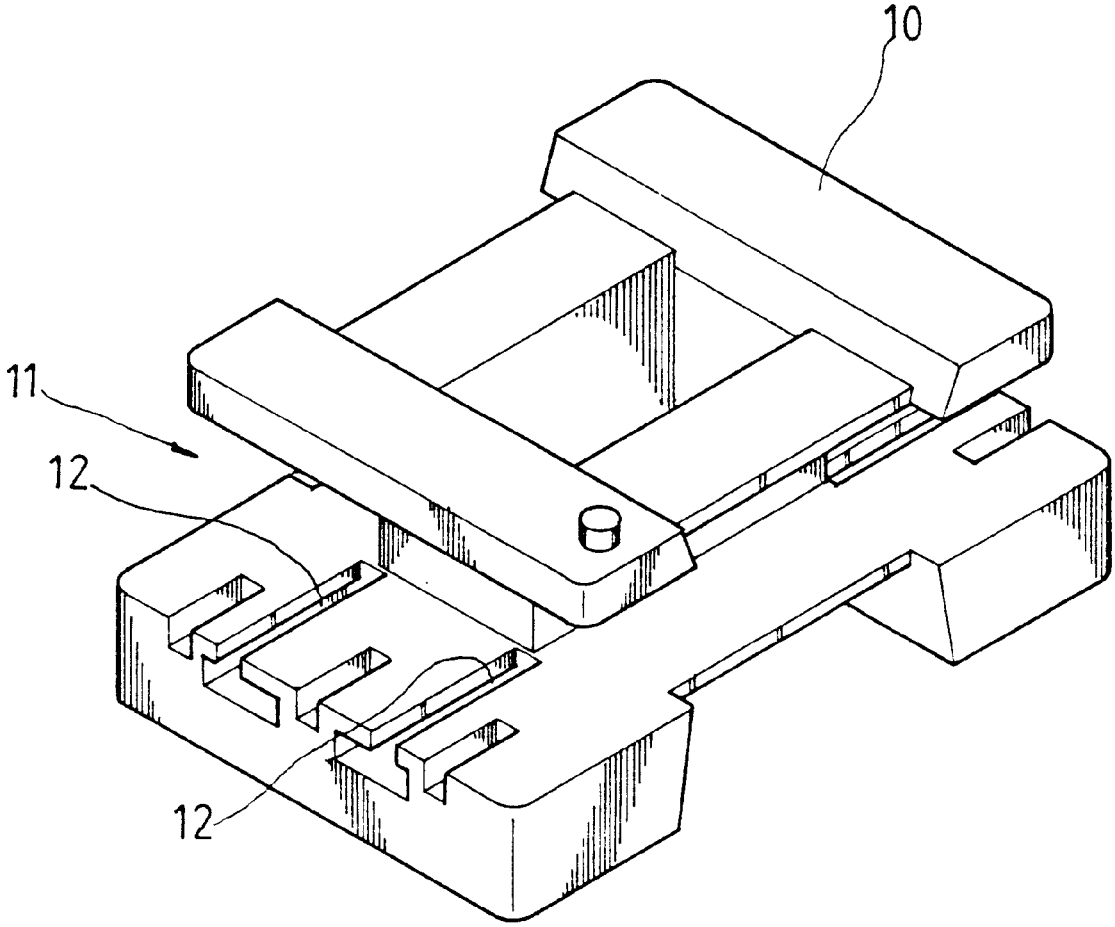
FIG. 1 (PRIOR ART)
FIG. 1 is a perspective view of a conventional coil rack.
Figure 3:
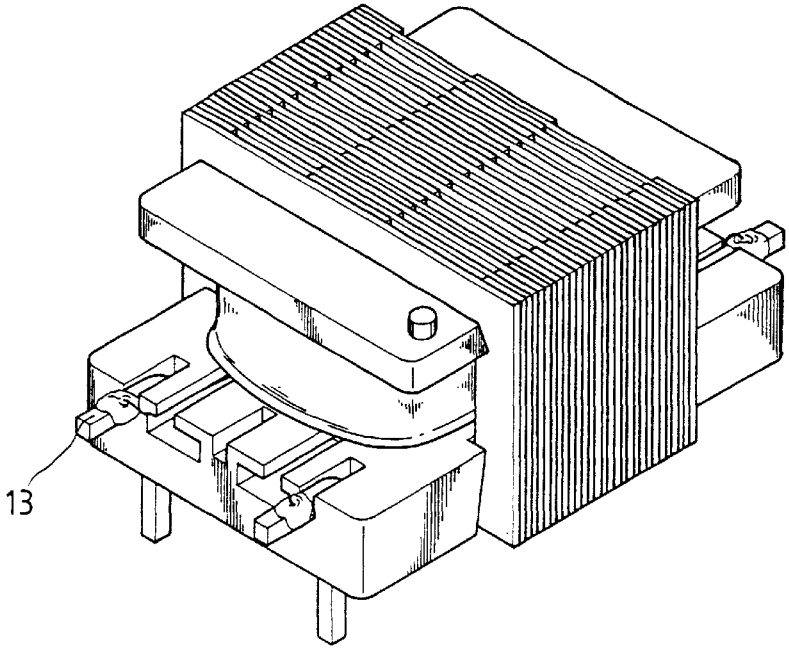
FIG. 3 is a perspective view of the transformer of FIG. 2.
Figure 2:
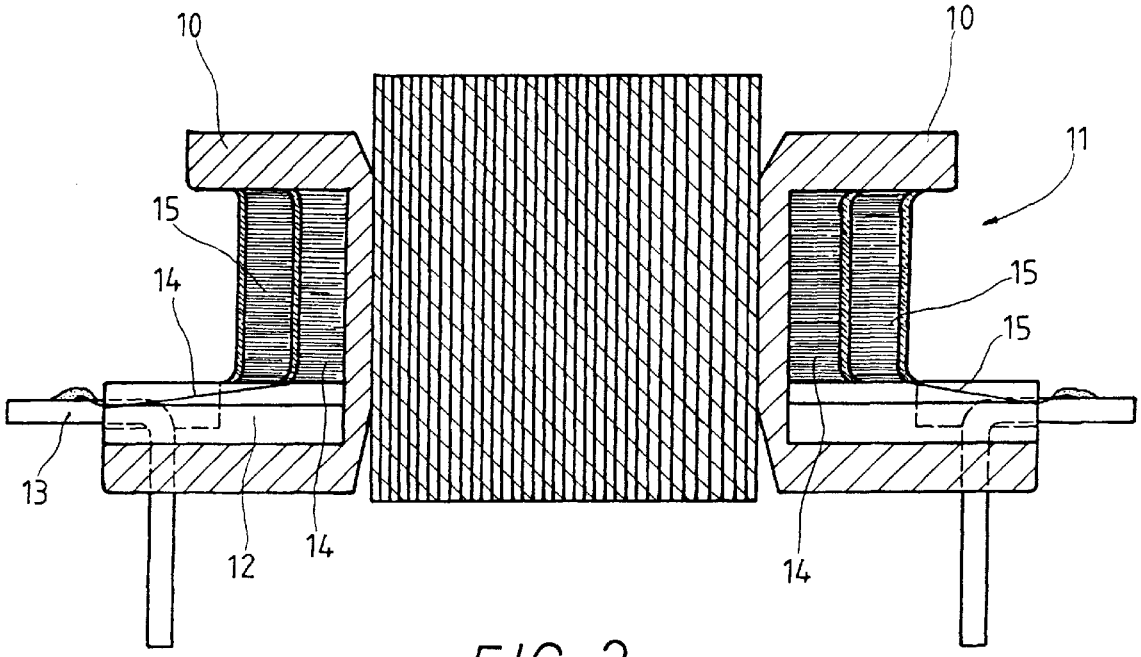
FIG. 2 is a side sectional view of a transformer formed from the conventional coil rack of FIG. 1.
Figure 4:
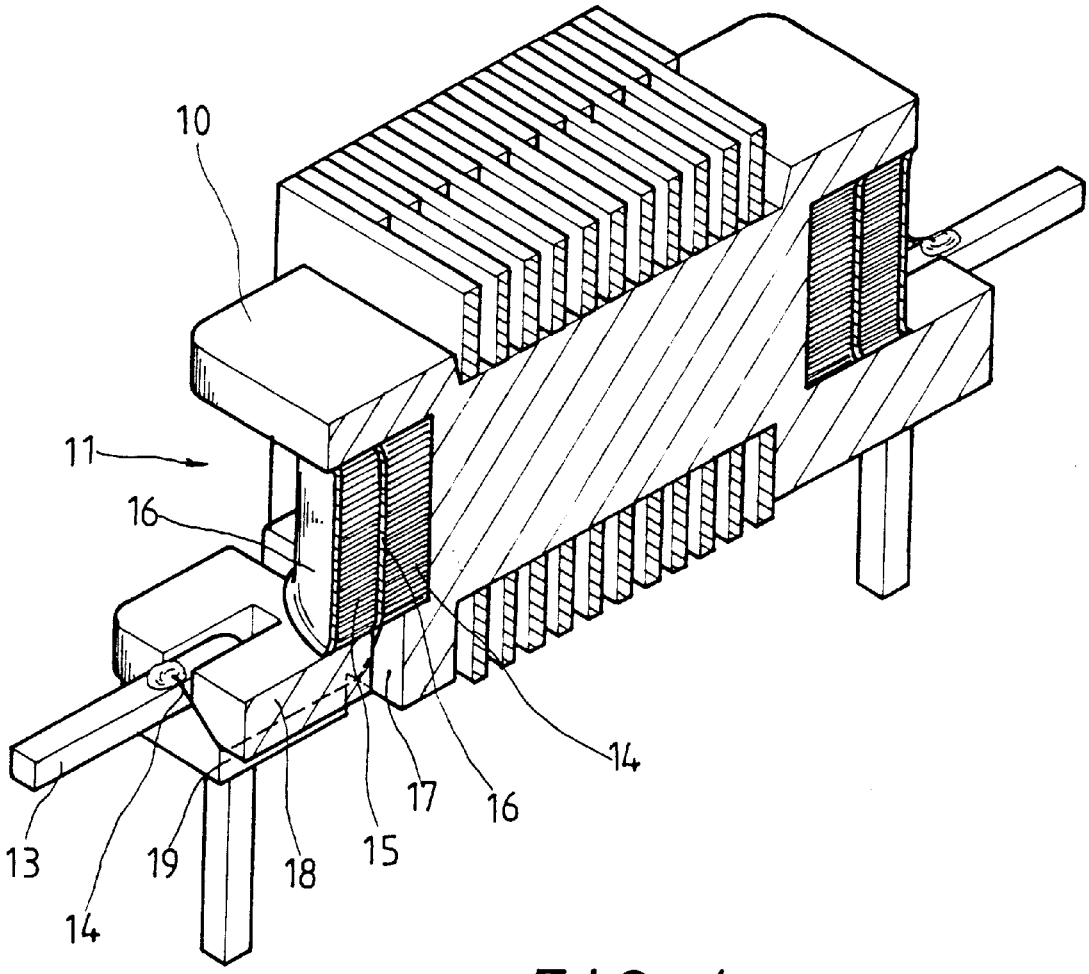
FIG. 4 is a perspective of a transformer formed from a coil rack according to the present invention, wherein one half of the transformer is cut away to clearly show the structure of the coil rack.
Figure 6:
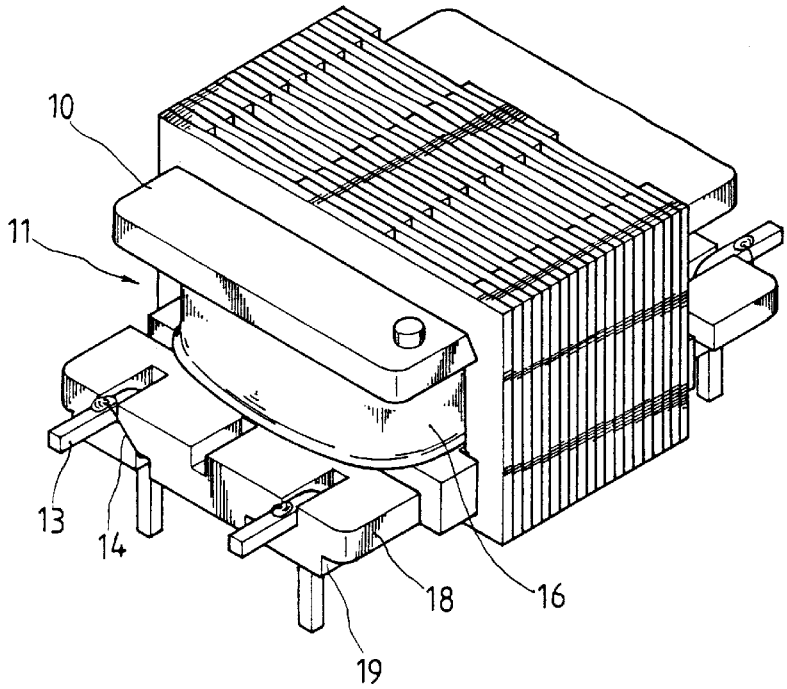
FIG. 6 is a complete perspective view of the transformer of FIG. 4.

Please refer to FIG. 4. The present invention includes a coil rack that has a form generally similar to the conventional coil rack 10 illustrated in FIGS. 1 to 3 and is therefore denoted by reference numeral 10, too. Like the conventional coil rack, the coil rack 10 of the present invention provides a coil winding seat 11 thereon for an inner coil winding 14, a first insulating layer 16, an outer coil winding 15, and a second insulating layer 16 to sequentially arrange therearound. The coil rack 10 of the present invention is improved and characterized in that the coil winding seat 11 is provided at each end with an axially extended through hole 17 at a position below the inner coil winding 14. The through hole 17 extends downward to end at a bottom surface of the coil rack 10. The portions of the coil rack 10 located radially outside the through holes 17 form two stoppers 18. Each stopper 18 is provided at a bottom surface with a horizontal open channel 19 leading to the through hole 17 at one end and one outer end of the coil rack 10 at another end. After the inner coil winding 14 is formed around the coil winding seat 11, two free ends of the inner coil winding 14 are separately axially guided downward to pass the through holes 17 and then turned outward to abut against the stoppers 18 before they are further radially guided outward to pass the horizontal open channels 19. After the free ends of the inner coil winding 14 are guided to extend from the open channels 19, they are separately welded to terminals 13 previously provided at outer ends of the coil rack 10. Then, the first insulating layer 16 and the outer coil winding 15 are sequentially provided around the inner coil winding 14. After the outer coil winding 15 is provided around the first insulating layer 16, two free ends thereof are welded to another two terminals 13 at two outer ends of the coil rack 10, forming a transformer as shown in FIG. 6.

Figure 5:
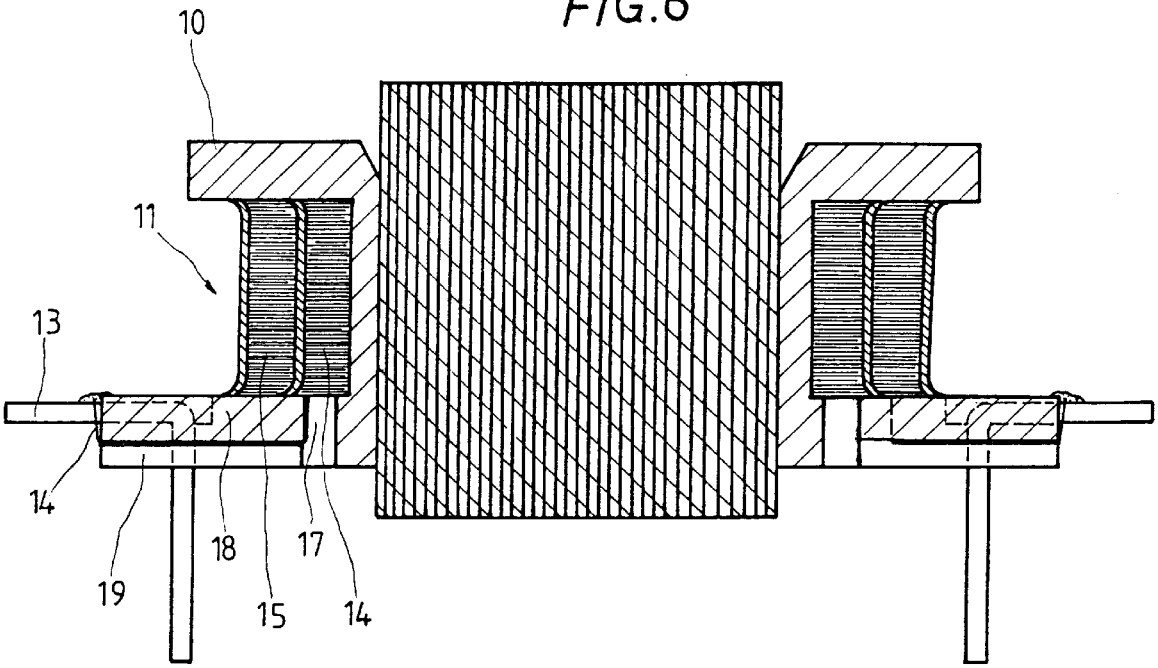
FIG. 5 is a side sectional view of the transformer of FIG. 4.

Please refer to FIGS. 4 and 5 at the same time. When the free ends of the inner coil winding 14 are guided to the terminals 13 by pulling them axially downward via the through holes 17 and then radially outward via the open channels 19, vertical walls of the stoppers 18 adjacent to the through holes 17 stop the free ends of the inner coil winding

14 turned outward from contacting with the outer coil winding 15 and therefore prevent any possible short circuit due to such contact. The provision of through holes 17, stoppers 18, and the open channels 19 on the coil rack 10 of the present invention distinguishes it from the conventional coil rack.

With the above arrangements, high bad yield in production of transformers due to the contact of the inner coil winding with the outer coil winding and the short circuit caused by such contact can be effectively eliminated and the overall quality of the transformers can be positively upgraded.

Like the conventional coil rack, the coil rack of the present invention can be integrally formed through injection molding of plastic material without the need to add any other parts to adversely increase the cost thereof.

What is claimed is:

1. A coil rack for a transformer, comprising a coil winding seat around which an inner coil winding and an outer coil winding are sequentially provided and insulated from each other by an insulating layer, said coil winding seat including a pair of ends, a bottom, a bottom surface and axially extending through holes extending downward to end at said bottom surface separately formed on said bottom of said coil winding seat at positions spaced below said inner coil winding, and stoppers separately located radially outside said through holes, each of said stoppers being provided at a bottom surface thereof with a radially extended open channel having an L-shaped cross section and linear sides, one end of which leads to said through hole corresponding to said stopper and another end to an adjacent outer end of said coil rack, such that free ends of said inner coil windings are separately pulled downward to pass said axially extended through holes and turned outward at said stopper to extend radially toward outer ends of said coil rack and are radially pulled outward via said open channels below said stoppers and welded to terminals at outer ends of the coil rack, such that said free ends of said inner coil winding are prevented by said stoppers from contacting with said outer coil winding to avoid a short circuit.

* * * * *